US008998605B2

(12) United States Patent
Bertolotti et al.

(10) Patent No.: US 8,998,605 B2
(45) Date of Patent: Apr. 7, 2015

(54) INSHOT BURNER FLAME RETAINER

(75) Inventors: Fabio P. Bertolotti, Bad Bentheim (DE); Ninev Karl Zia, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 750 days.

(21) Appl. No.: 13/245,341

(22) Filed: Sep. 26, 2011

(65) Prior Publication Data

US 2012/0085420 A1 Apr. 12, 2012

Related U.S. Application Data

(60) Provisional application No. 61/390,726, filed on Oct. 7, 2010.

(51) Int. Cl.
*F23D 14/70* (2006.01)
*F23D 14/08* (2006.01)

(52) U.S. Cl.
CPC ..... *F23D 14/08* (2013.01); *F23D 14/70* (2013.01); *F23D 2900/14021* (2013.01)

(58) Field of Classification Search
USPC ..... 431/144, 338, 286, 354
See application file for complete search history.

(56) References Cited

U.S. PATENT DOCUMENTS 2,901,032 A * 8/1959 Brola ..... 431/264
4,467,780 A 8/1984 Ripka
4,476,850 A 10/1984 Pickering
4,619,604 A 10/1986 Pickering
4,638,942 A 1/1987 Ballard et al.
4,648,551 A 3/1987 Thompson et al.
4,660,761 A 4/1987 Bussjager
4,688,547 A 8/1987 Ballard et al.
4,706,881 A 11/1987 Ballard
4,776,320 A 10/1988 Ripka et al.
4,792,089 A 12/1988 Ballard
4,860,231 A 8/1989 Ballard et al.
4,887,767 A 12/1989 Thompson et al.
4,896,411 A 1/1990 Dempsey
4,904,179 A 2/1990 Drago et al.
4,938,283 A 7/1990 Wood et al.
5,076,494 A 12/1991 Ripka
5,318,439 A * 6/1994 Sigler ..... 431/286
5,337,952 A 8/1994 Thompson
5,340,028 A 8/1994 Thompson
5,380,193 A 1/1995 Williams et al.
5,458,484 A 10/1995 Ripka
5,596,979 A 1/1997 Sobotka et al.
5,624,252 A 4/1997 Charles, Sr. et al.
5,746,194 A 5/1998 Legutko
5,791,893 A 8/1998 Charles, Sr. et al.
5,799,646 A 9/1998 Zia et al.
5,848,887 A 12/1998 Zabielski et al.
6,021,775 A 2/2000 Dempsey et al.
RE36,743 E 6/2000 Ripka
6,478,577 B1 * 11/2002 Maricic et al. ..... 431/353

(Continued)

*Primary Examiner* — Gregory Huson
*Assistant Examiner* — Nikhil Mashruwala
(74) *Attorney, Agent, or Firm* — Cantor Colburn LLP

(57) ABSTRACT

A burner insert for use with a burner is provided. The burner insert includes a cylindrical body member having an inlet end and an outlet end. The cylindrical body includes a central passage and a plurality of openings disposed about the central passage. One or more fins are axially disposed within the central passage. A plurality of rib members are coupled to the body, each of the plurality of rib members axially disposed within one of the plurality of openings.

13 Claims, 6 Drawing Sheets

(56) References Cited

U.S. PATENT DOCUMENTS

| | | | | |
|---|---|---|---|---|
| 6,857,868 | B1 * | 2/2005 | Li et al. | 431/266 |
| 6,860,734 | B2 | 3/2005 | Zia et al. | |
| 6,880,548 | B2 | 4/2005 | Schultz et al. | |
| 6,923,643 | B2 | 8/2005 | Schultz et al. | |
| 7,204,688 | B2 * | 4/2007 | Han | 431/354 |
| 7,255,155 | B2 | 8/2007 | O'Donnell et al. | |
| 7,850,448 | B2 | 12/2010 | Slaby | |
| 8,021,143 | B2 | 9/2011 | Slaby | |
| 2002/0006592 | A1 * | 1/2002 | Deblois | 431/338 |
| 2007/0082309 | A1 * | 4/2007 | Zia et al. | 431/354 |

* cited by examiner

INSHOT BURNER FLAME RETAINER

CROSS REFERENCE TO RELATED APPLICATIONS

This application is a non-provisional patent application which claims the benefit of U.S. Provisional patent application 61/390,726 filed Oct. 7, 2010, the entire contents of which are incorporated herein by reference.

BACKGROUND OF THE INVENTION

The subject matter disclosed herein relates to gas furnaces and in particular to gas furnaces having an inshot burner with a flame retention insert.

Gas fired appliances, such as residential and light commercial heating furnaces, often use a particular type of gas burner commonly referred to as an inshot burner. In this type of burner, fuel gas under pressure passes through a central port disposed at the inlet of a burner venturi. Atmospheric air is drawn into the burner and mixes with the fuel gas as it passes through the burner. In some constructions, a burner head insert, also referred to as a flame retention insert, made of compressed sintered or powdered metal is mounted in the outlet end of the burner tube. In operation, as gas is injected into the inlet end of the burner, it entrains air into the burner. This primary air/gas mix flows through the burner to the flame retention insert. The primary air/gas mix passes through outlet openings defined by the insert and burns as it exits the insert forming a flame projecting downstream from the burner head insert. Secondary air flows around the outside of the venturi tube and is entrained in the burning mixture downstream of the insert in order to provide additional air to complete the combustion process.

Conventional inshot burner designs sometimes provide less than desired performance for ignition, flame stability, noise and combustion efficiency. Ignition problems can arise when the combustion process is not anchored to the retention insert. For example, if the velocity of the primary air/gas flow from the insert is greater than the flame speed, the flame may lift off from the burner insert, i.e. the flame begins to burn at a location spaced from the outer face of the flame retention insert. Flame liftoff contributes to noise associated with the operation of inshot burners. Under other circumstances, the velocity of the air/gas mixture may be too slow when compared to the flame speed. When this occurs, the flame may flashback. Flashback is the burning of the gas within the burner itself. This condition can cause overheating and reduce the life expectancy of the burner.

Flame retention or burner head inserts have been provided in an attempt to achieve better flame stability and reduction of noise. Some flame retention inserts provide an inner flow passage and a plurality of secondary openings having smaller diameters arranged circularly around the central insert. While such flame retention inserts are helpful in addressing the problems discussed hereinabove, they may not adequately address the problem of flashback. Further, as it has become desirable to have smaller furnaces, the burner and flame retention inserts have become shorter in length. This decrease may result in less desirable performance in terms of combustion efficiency since the fuel and air streams have less flow length to mix prior to combustion.

Accordingly, while existing gas furnaces are suitable for their intended purposes, improvements may be made in improving the performance of the combustion process by providing a burner insert that stabilizes the combustion flame, increases the mixing of fuel and air and also decreases the potential for flashback.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

According to one aspect of the invention, a burner insert for a gas appliance is provided. The burner insert includes a body having an inlet end and an outlet end with a central passage therebetween, and a plurality of openings disposed about the central passage. A wall is disposed between the central passage and the plurality of openings. A plurality of fins are coupled to the wall and arranged within the central passage.

According to another aspect of the invention, a burner insert for use with a burner is provided. The burner insert includes a cylindrical body member having an inlet end and an outlet end, the cylindrical body member having a central passage and a plurality of openings circumferentially disposed about the central passage. At least one fin is axially disposed within the central passage. A plurality of rib members are provided, wherein one of the plurality of rib members is disposed within each of the plurality of openings.

According to yet another aspect of the invention, a method of operating a burner in a gas appliance is provided. The method includes providing a burner insert at one end of the burner, the burner insert having an annular body having a central passage and a plurality of openings disposed about the central passage. A plurality of fins are provided that are coupled to the body and disposed within the central passage. A gas stream is injected axially within the burner into the burner insert.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
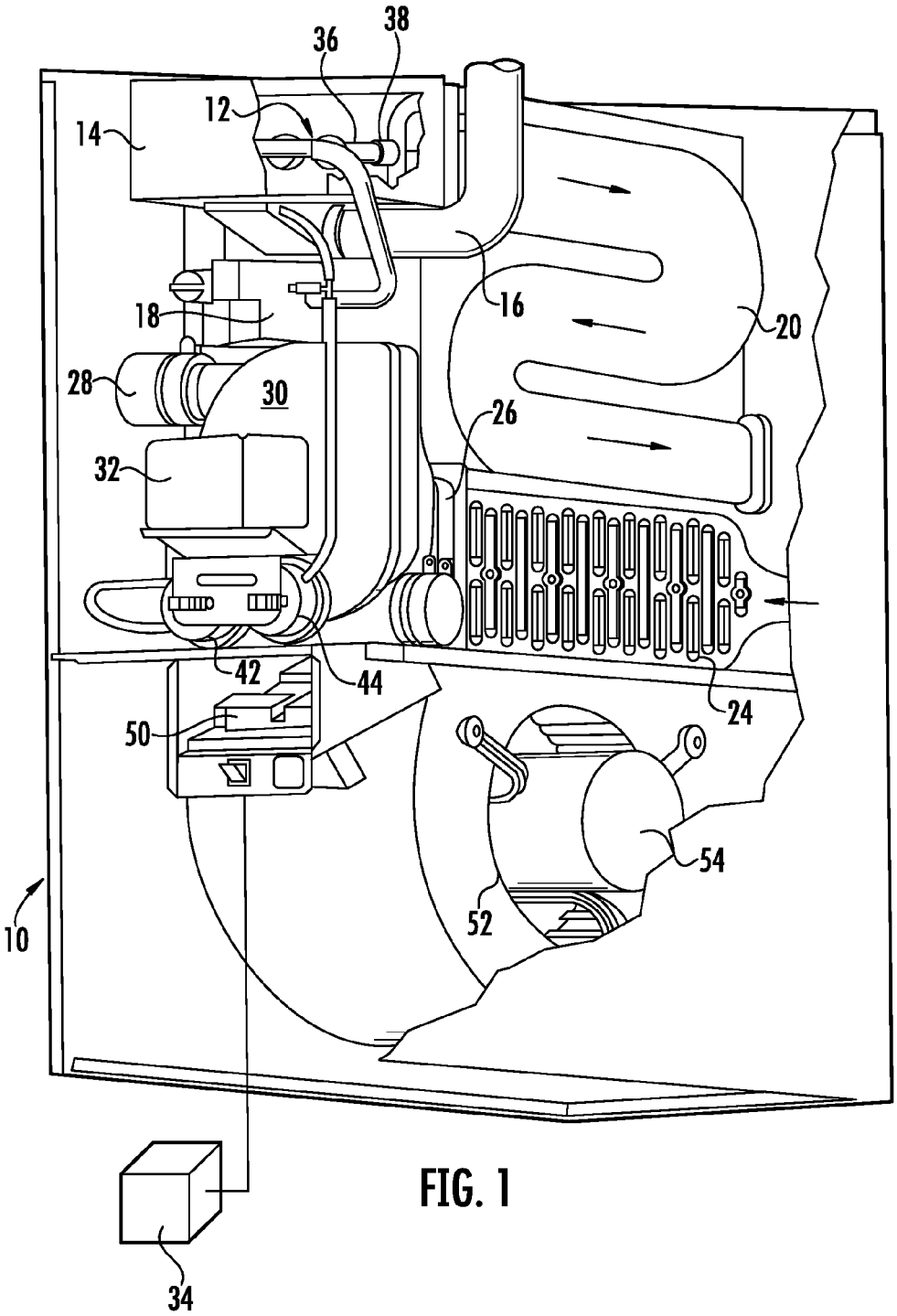
FIG. 1 is a perspective cut away illustration of a gas furnace in accordance with an embodiment of the invention.

FIG. 1 is a perspective cutaway view of a gas-fired appliance, such as a furnace 10. Furnace 10 includes burner assembly 12, burner box 14, combustion air pipe 16, gas valve 18, primary heat exchanger 20, condensing heat exchanger 24, condensate collector box 26, exhaust vent pipe 28, induced draft blower 30, inducer motor 32, thermostat 34, low pressure switch 42, high pressure switch 44, and furnace control 50.

Burner assembly 12 is located within burner box 14 and is supplied with air via combustion air pipe 16. As will be discussed in more detail below, the burner assembly 12 includes a burner tube 36 with a burner insert 38 arranged at one end. Fuel gas is supplied to burner assembly 12 through gas valve 18, which may be a solenoid-operated gas valve, and is ignited by an igniter assembly (not shown). The gases produced by combustion within burner box 14 flow through a heat exchanger assembly, which includes primary or non-condensing heat exchanger 20, secondary or condensing heat exchanger 24, and condensate collector box 26. It should be appreciated that while only a single heat exchanger 20 is illustrated, the furnace 10 may have multiple heat exchangers 20 coupled in parallel to the burner box 14. The gases are then vented to the atmosphere by inducer motor 32 through exhaust vent pipe 28. The flow of these gases, herein called combustion gases, is maintained by induced draft blower 30, which is driven by inducer motor 32. Inducer motor 32 is driven in response to speed control signals that are generated by a furnace control circuit located within furnace control 50, in response to the states of low pressure switch 42 and high pressure switch 44, and in response to call-for-heat signals received from thermostat 34 in the space to be heated.

Air from the space to be heated is drawn into furnace 10 by blower 52, which is driven by blower motor 54 in response to speed control signals that are generated by furnace control 50. The discharge air from the blower 52, herein called circulating air, passes over condensing heat exchanger 24 and primary heat exchanger 20 in a counter-flow relationship to the flow of combustion air, before being directed to the space to be heated through a duct system (not shown).

Figure 2:
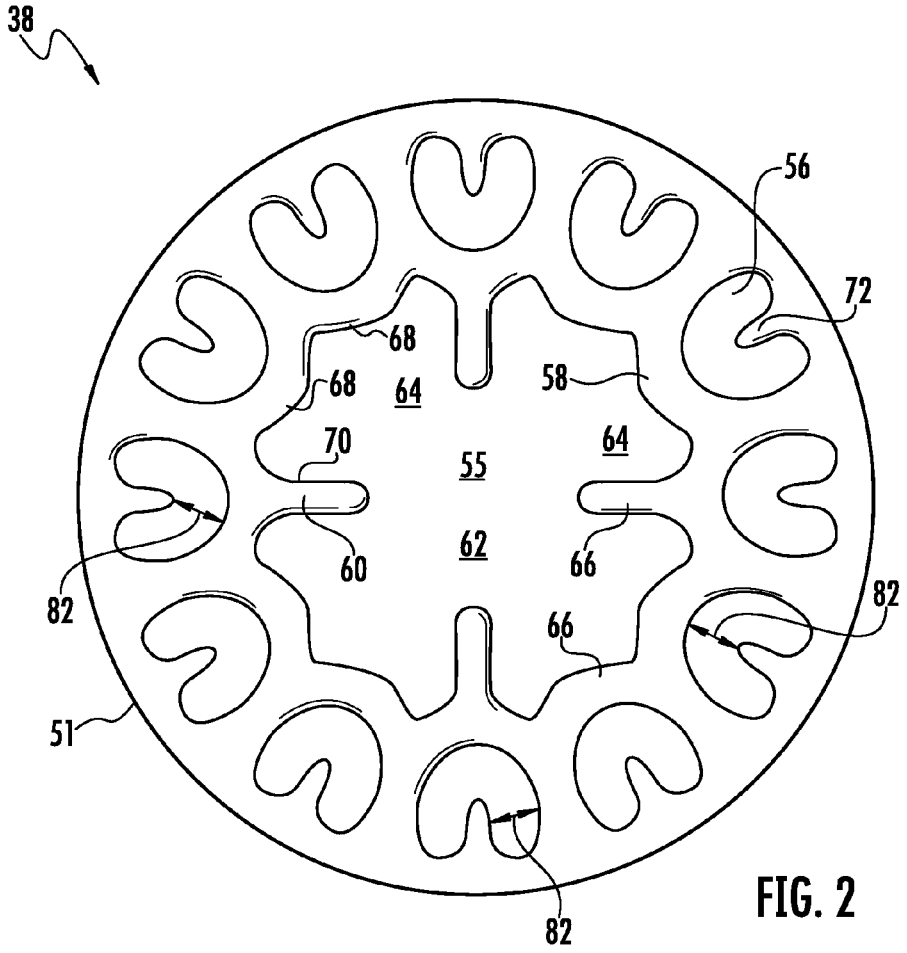
FIG. 2 is an elevation view illustration of a burner insert in accordance with an embodiment of the invention.
Figure 3:
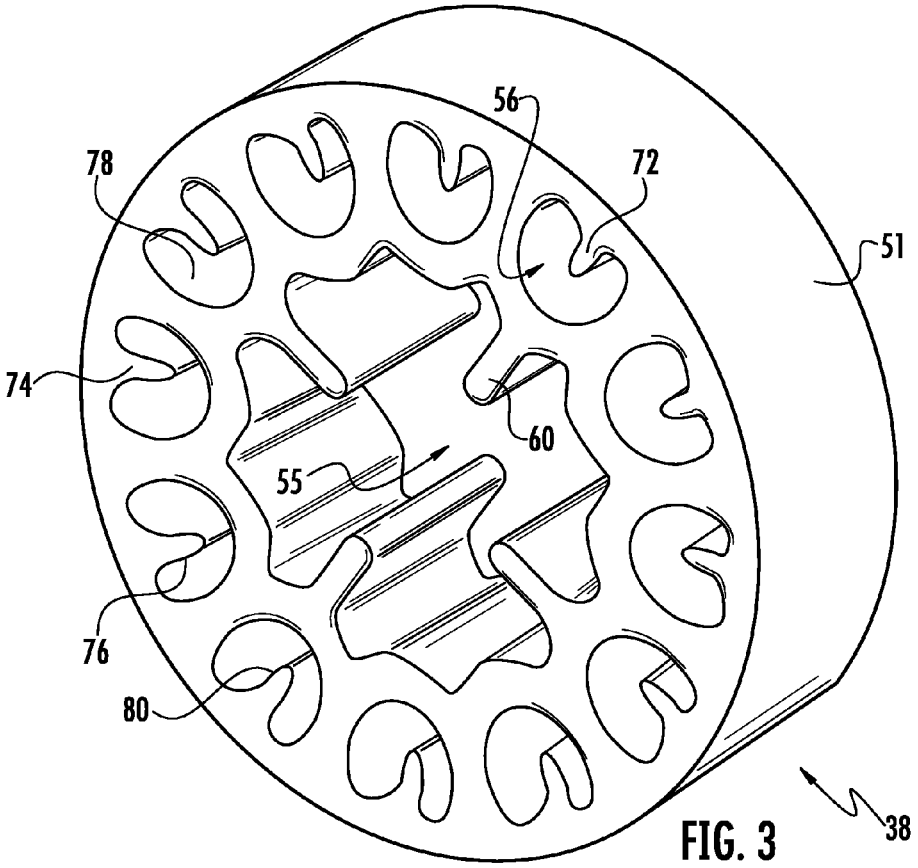
FIG. 3 is a perspective view illustration of the burner insert of FIG. 2.
Figure 4:
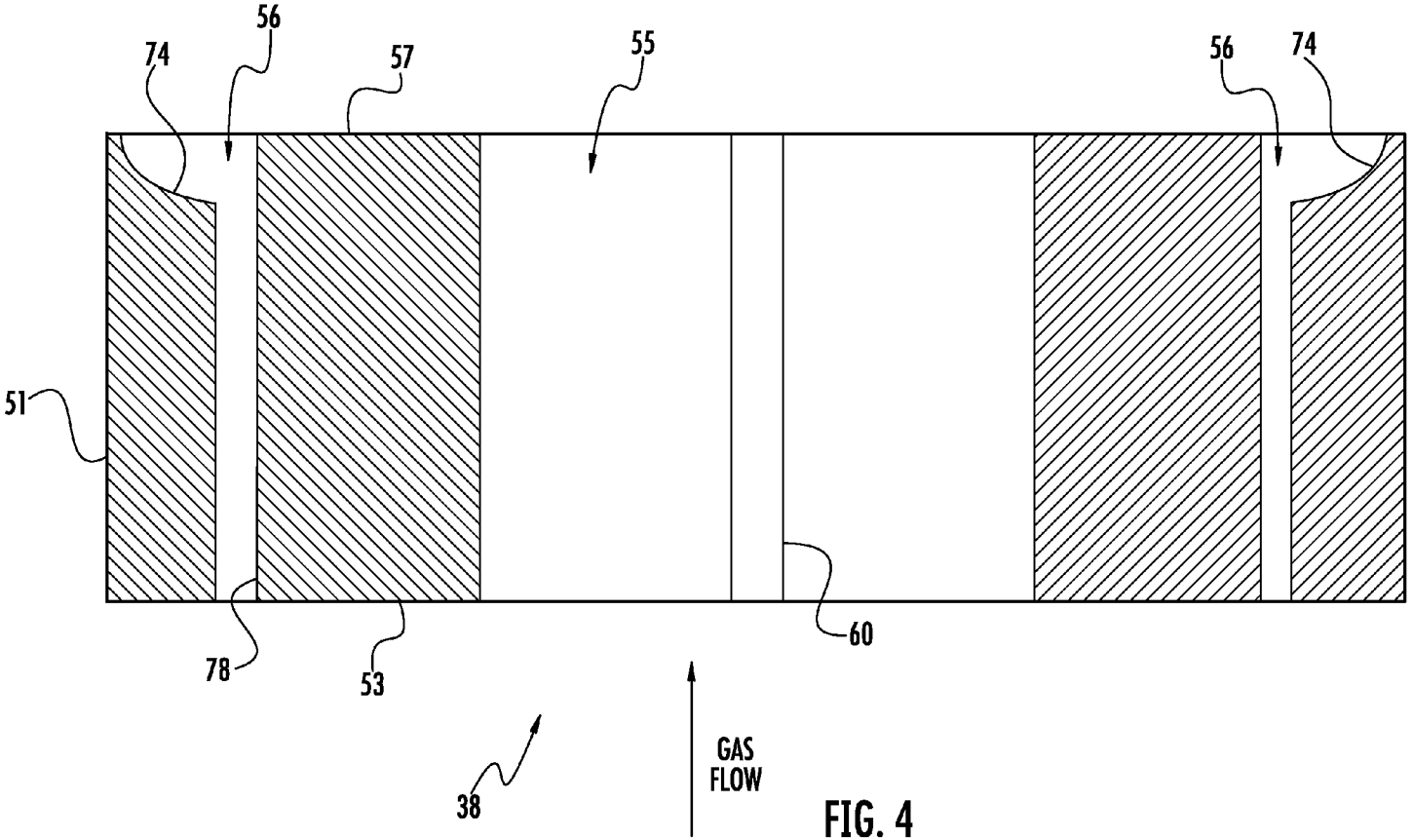
FIG. 4 is a sectional side view illustration of the burner insert of FIG. 2.

The burner assembly 14 includes a burner 36 with an insert 38 arranged at one end. The insert 38, shown in FIGS. 2-4, sometimes referred to as an inshot burner flame retainer is arranged at the exit of the burner 36. During operation, gas (either natural gas or propane) is supplied and injected axially into the burner tube 38 towards the insert 38. Combustion air is mixed with the gas and burned within the combustion chamber. As the size of the furnace decreases, the space for mixing of the air and gas becomes decreased. It should be appreciated that the smaller the length of the burner tube, less mixing of the gas and combustion air will occur prior to combustion. As will be discussed in more detail below, the insert 38 provides advantages in mixing the combustion air with the gas and also provides an anchor for the combustion process. The insert 38 provides additional advantages in applications where a small furnace is desired. The insert 38 also provides advantages in preventing or minimizing flashback, a phenomena where the flame burns within the burner 36. Due to a faster flame speed, the issue of flashback is more likely in applications where propane is used as the fuel.

It should be appreciated that while embodiments herein discuss the insert 38 in relation to a condensing furnace, the claimed invention should not be so limited. In other embodiments, the insert 38 is used in non-condensing furnaces as well.

The insert 38 includes an annular body 51 having a central passage 55. In the exemplary embodiment, the body 51 is made from a powdered metal material and has an outer diameter approximately 26 millimeters and a width of 9 millimeters. The body 51 has an inlet end 53 and an outlet end 55. The outlet end 55 is adjacent the exit area of the burner 36. A plurality of openings 56 is disposed circumferentially about the central passage 55. In one embodiment, a substantially uniform wall 58 is disposed between the openings 56 and the central passage 55. The wall 58 has a thickness sized to decrease, or minimize, the wall thickness based on the manufacturing process. In an embodiment where the body 51 is made from a powered metal a minimum wall thickness is between 1.14-1.53 millimeters for example. The curvature of the wall 58 substantially follows the curvature of the openings 56.

The central passage 55 is partially segmented by a plurality of walls or fins 60. The fins 60 extend radially inward from the wall 58 and extend the width of the insert 38 to segment the central passage 55. The fins 60 perturb the flow of gas and combustion air passing through the insert 38 and generating turbulence within the flow. This turbulence increases the amount of mixing between a gas rich central area and a gas-lean perimeter to produce a more uniform mixture at the outlet of the burner 36. Each of the fins 60 and the wall 58 include a chamfered or rounded corner area 66 adjacent the outlet end that reduces pressure drop as the gas and combustion air mixture exits the insert 38. In the exemplary embodiment, the insert 38 includes four fins 60 that divide the central passage 55 into a central area 62 and four segment areas 64 disposed radially about the central area 62. Two curved wall segments 68 and a pair of sidewalls 70 of fins 60 define each segment area 64. In one embodiment, the fins 60 are sized to accommodate a minimum wall thickness for manufacturing process, such as 1.14-1.53 millimeters for a powdered metal for example.

Each of the plurality of openings 56 is substantially circular in shape. In one embodiment, each of the openings 56 includes a protrusion or rib member 72. In the exemplary embodiment, the rib member 72 is triangular in shape having a base area adjacent the outer diameter of the body 51 and tapers to a distal end. The rib member 72 includes a curved surface 74 adjacent the outlet end 55. The curvature of the surface 74 is arranged to curve from the base area to the distal end such that the distal end is below the outlet end 55 and within the opening 56. The rib member 72 extends the length of the opening 56 from the curved surface to the inlet end 53. The opening 56 and rib member 72 each further includes a pressure drop reduction feature, such as a chamfer or rounded area 76, that transitions between the inner wall 78 of the opening 56 and the sidewall 80 of the rib member 72 respectively. The chamfer area 76 provides advantages in reducing the pressure drop of the gas and combustion air mixture as it exits the outlet end 57.

In one embodiment, the rib member 72 and opening 56 are sized such that the maximum distance 82 between the rib member 72 and the inner wall of the opening 56 is less than a predetermined distance for reducing the probability of flashback occurring. As discussed above, flashback is a phenomenon that occurs when the flame front of the combustion process moves from the outlet end 57 into the insert 38 and the burner 36. Flashback is undesirable as it may result in increased temperatures within the insert 38 and the burner 36. In the exemplary embodiment, the distance 82 is equal to or less than 3.3 millimeters.

It should be appreciated that the central passage 55, fins 60, and wall 58 cooperate to increase the length of the surface perimeter relative for a given open area of central passage 55 and openings 56. The increasing of the surface perimeter provides advantages in quenching flashback occurrences and providing an anchor location for the flame front of the combustion process within the burner box 14. In the exemplary embodiment, the insert 38 has a perimeter per opening area ratio equal to or greater than 0.50.

Figure 5:
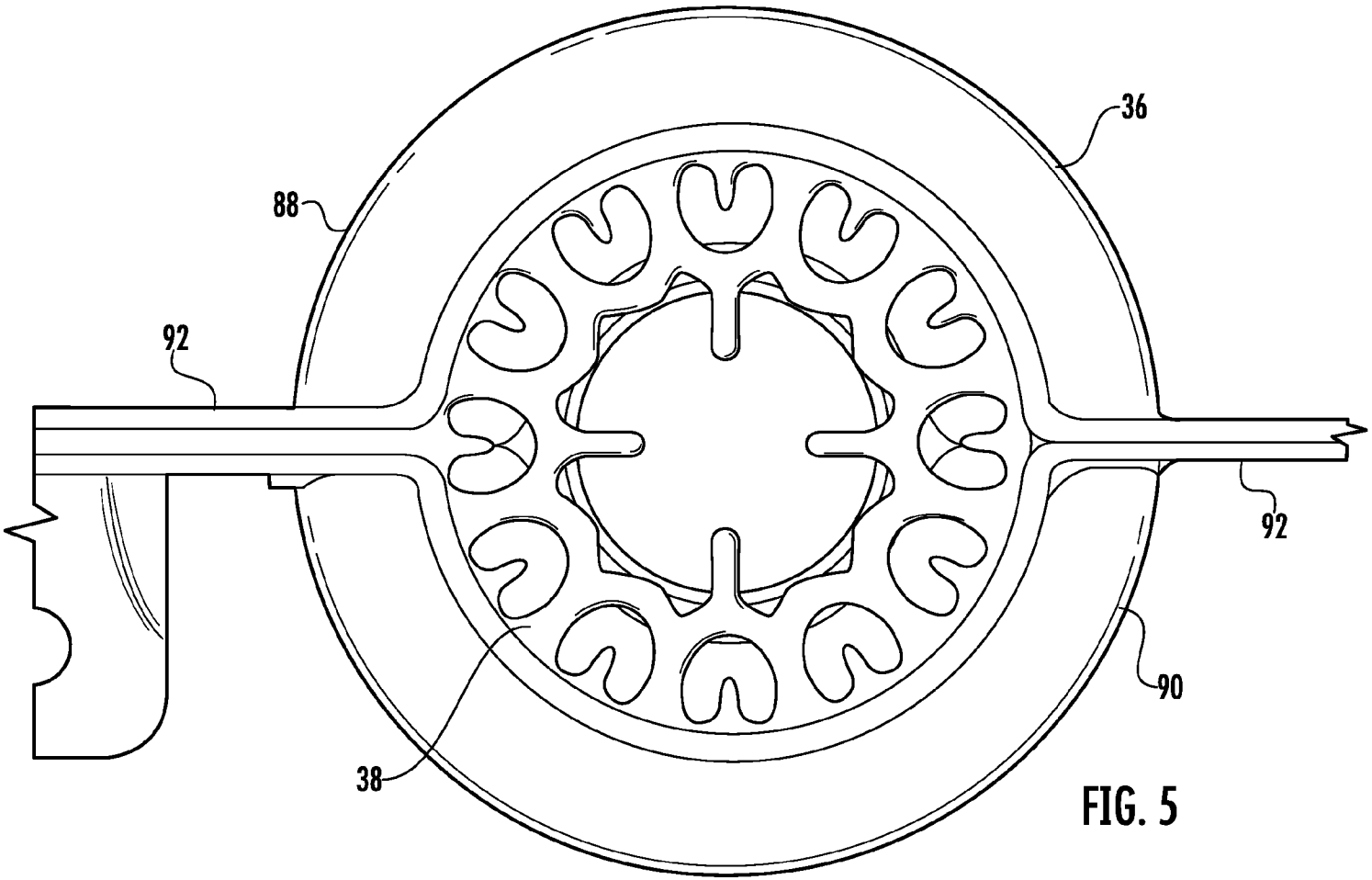
FIG. 5 is an elevation view illustration of the burner insert of FIG. 2 assembled in a burner; and, FIG. 6 is a perspective view illustration of the burner of FIG. 2 assembled in a burner.
Figure 6:
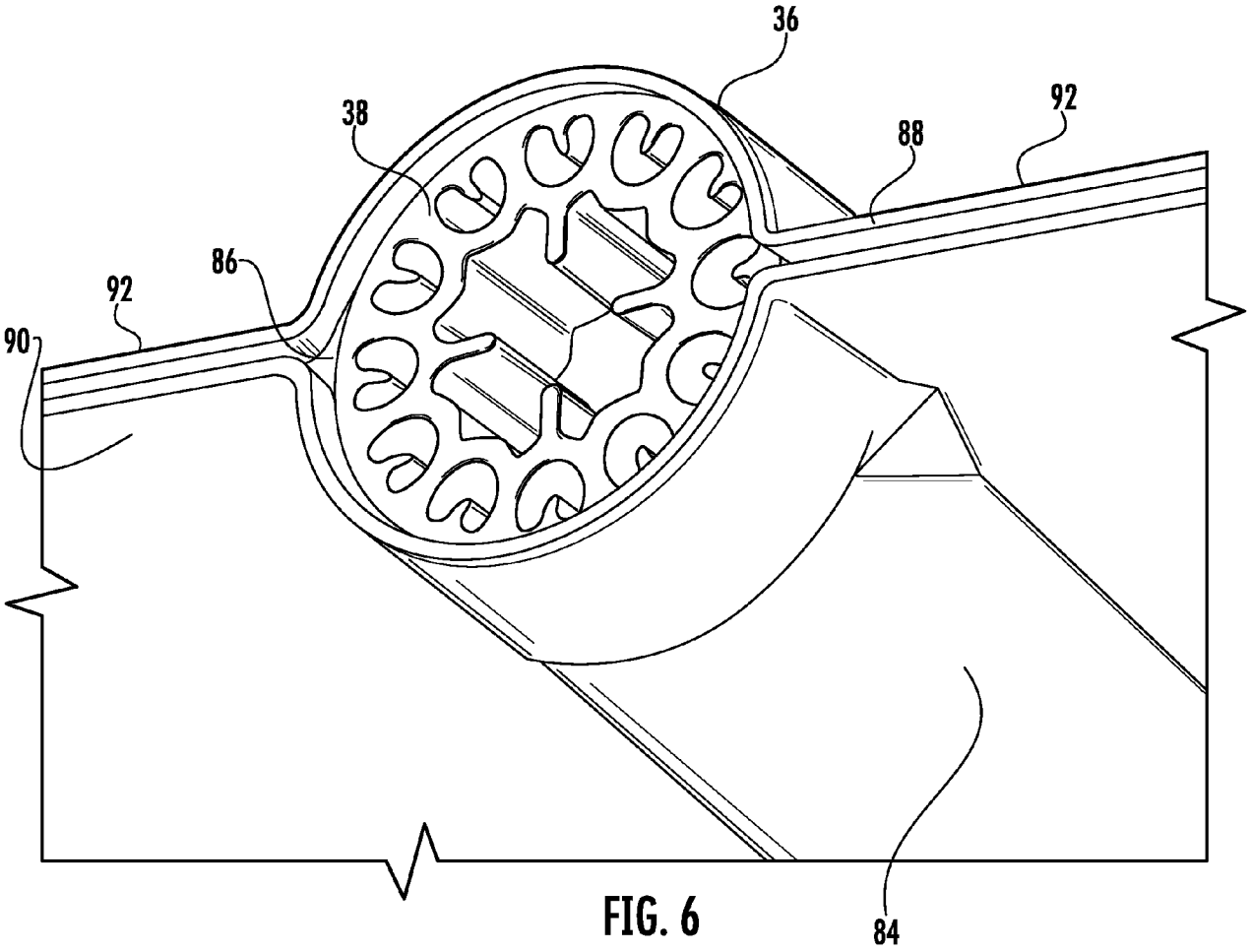

One embodiment of the burner assembly 12 is illustrated in FIGS. 5-6. In this embodiment, the burner 36 includes a generally cylindrical venturi portion 84 that receives gas from an inlet orifice (not shown). The venturi portion 84 includes a recessed area 86 that retains the insert 38 within the venturi portion 84. In one embodiment, the burner 36 includes a first half 88 and a second half 90 that cooperate to define the venturi portion 84 and a pair of flanges 92 extending from the venturi portion 84. In operation, the inlet orifice injects a fuel gas stream axially into the burner venturi portion 84. The injection of the gas combined with combustion air travels along the length of the venturi portion 84 and enters the insert 38. The fins 60 and rib members 72 create turbulence to increase the mixture of the combustion air with the gas. An igniter assembly (not shown) starts the combustion process within the combustion chamber adjacent the outlet end 57. The flame front of the combustion process remains adjacent the outlet end 57 during operation.

As disclosed, some embodiments of the invention may include some of the following advantages: a burner insert with increased perimeter relative to open area, a burner insert with improved flashback quenching, a burner insert with low pressure drop mixture features, and a burner insert that may be used in a smaller furnace.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A burner insert for a gas appliance comprising:

a body of the burner insert having an inlet end and an outlet end with a central passage therebetween, and a plurality of openings disposed about the central passage;

a wall disposed between the central passage and the plurality of openings, the wall having a curvature to follow the curvature of the plurality of openings;

a plurality of fins coupled to the wall and arranged within the central passage;

wherein each of the plurality of openings includes a rib member; wherein each rib member has a distal end from a base area, each rib member being triangular in shape and tapering from the base area to the distal end; and wherein each rib member has a curved surface extending from the outlet end into the respective opening.

2. The burner insert of claim 1 wherein:

each rib member includes a first pressure drop feature adjacent outlet end; and the plurality of openings include a second pressure drop feature adjacent the outlet end.

3. The burner insert of claim 1 wherein the central passage, the plurality of fins, and the wall cooperate to have a perimeter to opening ratio equal to or greater than 0.5.

4. A burner insert for use with a burner comprising:

a cylindrical body member of the burner insert having an inlet end and an outlet end, the cylindrical body member having a central passage and a plurality of openings circumferentially disposed about the central passage;

at least one fin extending radially into the central passage, the at least one fin extending axially between the inlet end and the outlet end; and a plurality of rib members, wherein one of the plurality of rib members is disposed within each of the plurality of openings wherein the at least one fin divides the central passage into at least two segments, each segment including at least two curved wall segments, each curved wall segment being disposed between the central passage and one of the plurality of openings, wherein the curvature of each curved wall segment follows the curvature of the plurality of openings.

5. The burner insert of claim 4 wherein each of the at least one fin and each of the curved wall segment includes pressure drop feature adjacent the outlet end.

6. The burner insert of claim 5 wherein each rib member includes a curved surface extending from the outlet end into the associated one of the plurality of openings, the curved surface having a first end adjacent the outlet end and a distal end disposed within the associated one of the plurality of openings.

7. The burner insert of claim 6 wherein a largest distance between the rib member and an inner wall of the associated one of the plurality of openings is equal to or less than 3.3 millimeters.

8. The burner insert of claim 7 wherein each of the at least two curved wall segment has a substantially uniform wall thickness.

9. The burner insert of claim 8 wherein the central passage, the at least one fin, and the at least two curved wall segments cooperate to have a perimeter to opening ratio at the outlet end equal to or greater than 0.50.

10. A method of operating a burner in a gas appliance comprising:

providing a burner insert at one end of the burner, the burner insert having an annular body having a central passage and a plurality of openings disposed about the central passage, each of the plurality of openings having a triangularly tapering rib extending therein, each rib having a curved surface extending from an end of the body into the associated opening;

providing the body with a plurality of fins extending radially into the central passage between an inlet and an outlet of the body;

providing the body with a curved wall between the plurality of openings and the plurality of fins, wherein the wall has a curvature to follow the curvature of the plurality of openings; and injecting a gas stream axially within the burner into the burner insert.

11. The method of claim 10 further comprising limiting a largest distance between the rib member and a side wall in the associated on of the plurality of openings to be equal to or less than 3.3 millimeters.

12. The method of claim 11 wherein:

each rib member has a first pressure drop feature adjacent the outlet end; and, each of the plurality of fins having a second pressure drop feature adjacent the outlet end.

13. The method of claim 10 further comprising creating turbulence in the gas stream with the plurality of fins.

* * * * *